United States Patent [19]

Corcokios

[11] 4,194,869

[45] Mar. 25, 1980

[54] STATOR VANE CLUSTER

[75] Inventor: Nicholas Corcokios, Palm Beach Gardens, Fla.

[73] Assignee: United Technologies Corporation, Hartford, Conn.

[21] Appl. No.: 920,583

[22] Filed: Jun. 29, 1978

[51] Int. Cl.[2] ..... F01D 1/04

[52] U.S. Cl. ..... 415/216

[58] Field of Search ..... 415/216, 217, 218, 185, 415/189, 191, 193, 195, 137, 138, 139; 416/191, 193 A, 213 A

[56] References Cited

U.S. PATENT DOCUMENTS

| | | | |
|---|---|---|---|
| 3,302,926 | 2/1967 | Bobo | 415/216 |
| 3,363,416 | 1/1968 | Heybyrne | 415/216 X |
| 3,751,182 | 8/1973 | Brown | 416/191 |
| 3,824,034 | 7/1974 | Leicht | 415/217 |
| 3,923,420 | 12/1975 | Chifos | 416/190 |
| 4,015,910 | 4/1977 | Harmon et al. | 415/217 |

FOREIGN PATENT DOCUMENTS

| | | | |
|---|---|---|---|
| 128499 | 6/1950 | Sweden | 415/216 |
| 128190 | 7/1948 | United Kingdom | 415/138 |

*Primary Examiner*—Leonard E. Smith
*Attorney, Agent, or Firm*—Robert C. Walker

[57] ABSTRACT

A structure for clustered stator vanes of the type utilized in axial flow gas turbine engines is disclosed. Concepts and techniques for retaining the vanes in position within the engine are developed. The concepts are well suited to structures in which the vanes are metallurgically joined. In one embodiment the stator vanes are grouped in pairs of a first, or principal vane and a second, or secondary vane each. East secondary vane is joined to a complementary principal vane along planes which preclude radial or axial movement of the secondary vane with respect to the principal vane, in the event that the bond between the joined vanes fails.

3 Claims, 4 Drawing Figures

FIG. 2
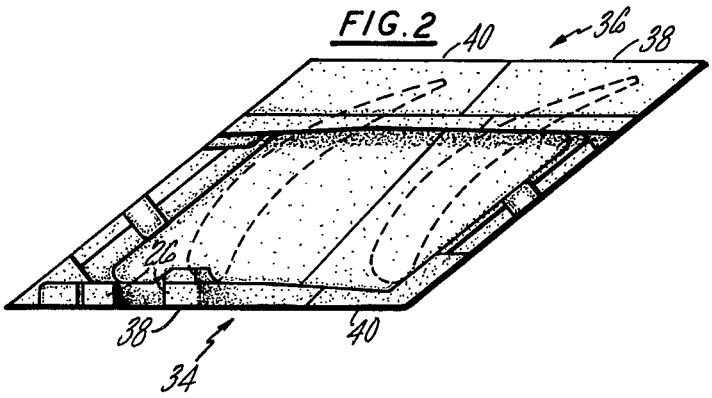
FIG. 1
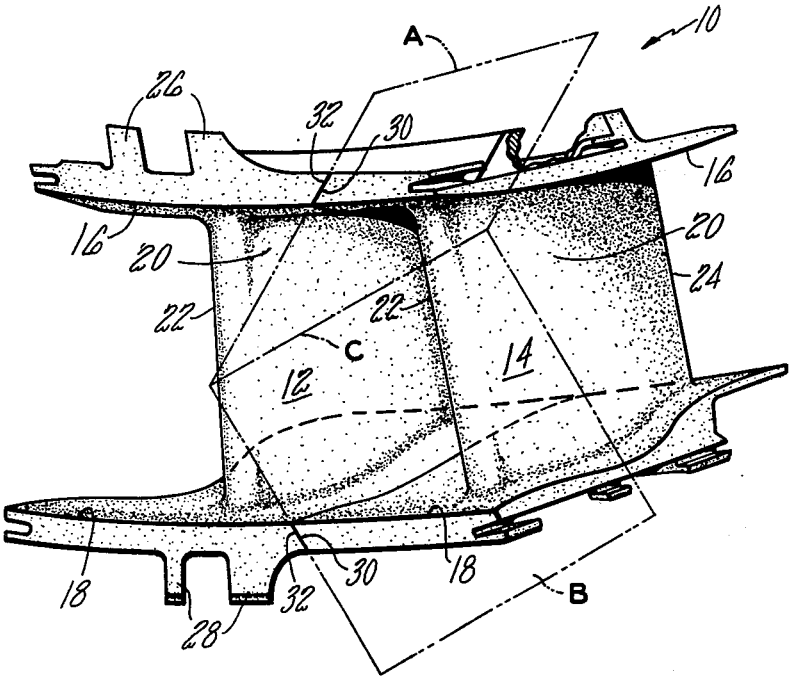
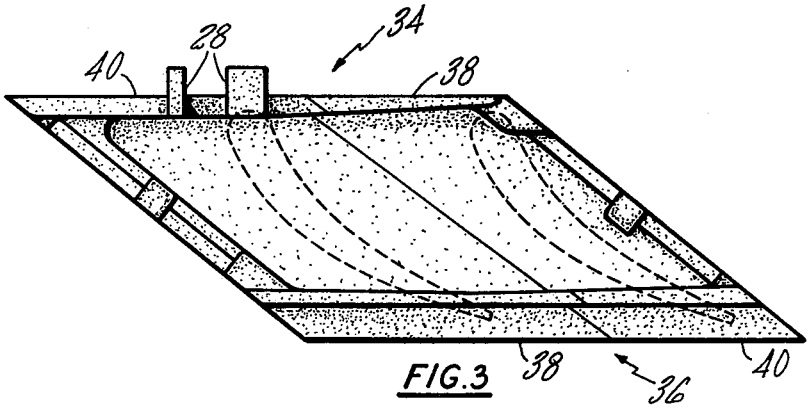
FIG. 3

STATOR VANE CLUSTER

The Government has rights in this invention pursuant to Contract No. F33615-76-C-5151 awarded by the Department of the Air Force.

BACKGROUND OF THE INVENTION

This invention relates to gas turbine engines and, more specifically to stator vane clusters formed of two or more individual vanes.

The concepts have direct applicability in the remanufacture of stator vane clusters from salvageable vane components. One such technique for remanufacturing vane clusters is taught in U.S. Pat. application Ser. No. 920,582, filed June 29, 1978.

SUMMARY OF THE INVENTION

A primary object of the present invention is to provide retention of clustered vanes in a gas turbine engine. Structure suited for use in conjunction with bonded vanes is sought, and a specific object is to provide retention of the vanes in the event of failure of the bond between vanes.

According to the present invention, first and second vanes of a vane cluster are joined at the inner platforms and at the outer platforms of the vanes along planes which intersect to form a line of intersection passing between the inner and outer platforms, and which are so oriented as to cause the platforms of one of said vanes to have inwardly facing, joining surfaces and the platforms of the other of said vanes to have outwardly facing, joining surfaces.

According to a more detailed embodiment of the invention the bond planes are oriented so as to form the platforms to a trapezoidal geometry wherein the longer of the parallel sides of each platform aligns with the shorter of the parallel sides of the adjacent platform.

A primary feature of the present invention is the orientation of the planes at which the vanes are joined. The line of intersection of the joining planes passes between the inner and outer platforms of the cluster so as to form inwardly facing, joining surfaces on one vane and outwardly facing, joining surfaces on the adjacent vane. In one detailed embodiment the planes cause the platforms to be trapezoidal in shape with the longer of the parallel sides of each platform aligning with the shorter of the parallel sides of the adjacent platform.

A primary advantage of the present invention is the inability of the first and second vanes to displace radial with respect to one another in the event of failure of the bonds between vanes. In at least one of the more detailed embodiments, a further advantage is the inability of the first and second vanes to displace axially with respect to one another in the event of failure of the bonds between vanes.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a front view of a two vane cluster formed in accordance with the structure of the present invention;

FIG. 2 is a top view of the FIG. 1 vane cluster illustrating the inner platforms of the vanes;

FIG. 3 is a bottom view of the FIG. 1 vane cluster illustrating the outer platforms of the vanes.

DETAILED DESCRIPTION

Figure 4:
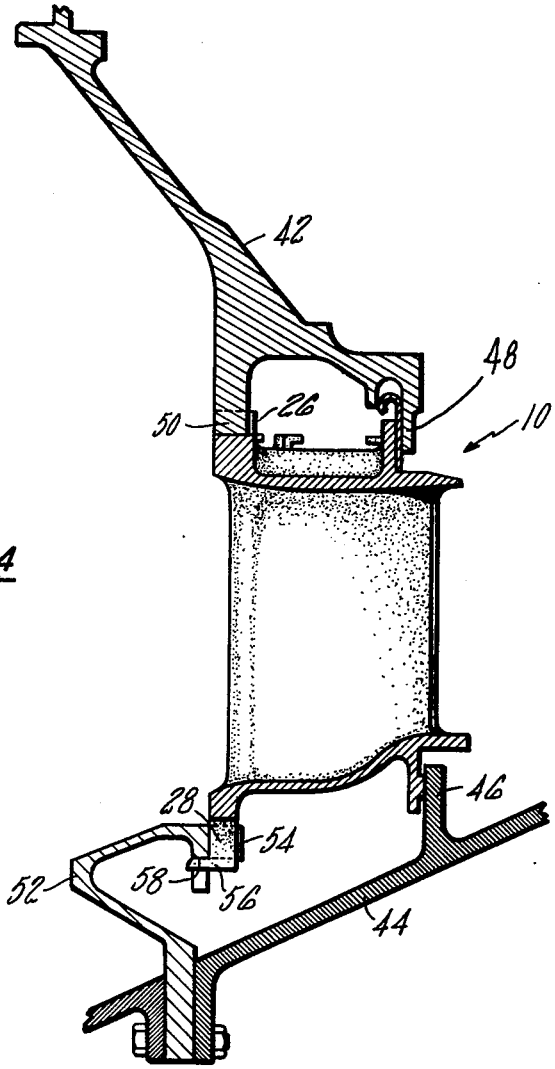
FIG. 4 is a simplified view of a stator vane cluster as installed in a gas turbine engine.

A vane cluster 10 of the type disposed in end to end relationship in a gas turbine engine to form a stator stage is illustrated in FIG. 1. The cluster is formed of a first, or principal vane 12 and a second, or secondary vane 14. Each vane has an inner platform 16, an outer platform 18, and an airfoil section 20 extending therebetween. Each airfoil section has a leading edge 22 and a trailing edge 24. The principal vane has attachment means 26 at the inner platform and attachment means 28 at the outer platform. The principal and secondary vanes are joined at the inner platforms along a bond plane A and at the outer platforms along a bond plane B. The bond planes intersect along a line of intersection C which passes between the inner and outer platforms of the cluster. The platforms of one vane, the primary vane as illustrated, have inwardly facing, joining surfaces 30. The platforms of the other vane, the secondary vane as illustrated, have outwardly facing, joining surfaces 32.

Referring to FIG. 2, the vane cluster has an upstream end 34 and a downstream end 36. The outer platforms of each vane have a trapezoidal shaped geometry. Each platform has two parallel sides including a longer parallel side 38 and a shorter parallel side 40. The longer parallel side of each platform aligns with the shorter parallel side of the adjacent platform. In the embodiment illustrated, the longer of the two parallel sides of the inner platform of the principal vane and the shorter of the two parallel sides of the inner platform of the secondary vane align at the upstream end of the cluster. The shorter of the two parallel sides of the inner platform of the principal vane and the longer of the two parallel sides of the inner platform of the secondary vane align at the downstream end of the cluster.

Referring to FIG. 3, the upstream end 34 and a downstream end 36 of the vane cluster are identified. The outer platforms of each vane have a trapezoidal shaped geometry. Each platform has a longer parallel side 38 and a shorter parallel side 40. The longer parallel side of each platform aligns with the shorter parallel side of the adjacent platform. In the embodiment illustrated, the longer of the two parallel sides of the outer platform of the principal vane and the shorter of the two parallel sides of the outer platform of the secondary vane align at the downstream end of the cluster. The shorter of the two parallel sides of the outer platform of the principal vane and the longer of the two parallel sides of the outer platform of the secondary vane align at the upstream end of the cluster.

FIG. 4 is a simplified view of a vane cluster 10 as typically mounted in a gas turbine engine. The engine has an inner case 42 and an outer case 44. The outer case has a downstream flange 46 which extends inwardly from the case. The inner case has a downstream flange 48. Each vane cluster 10 abuts the downstream flanges of the inner and outer case. The inner case further has a plurality of lugs 50 which engage the attachment means 26 at the inner platform of the principal vane. The outer case further has an inwardly extending flange 52 including a plurality of lugs 54 which engage the attachment means 28 at the outer platform of the principal vane. As is illustrated, the attachment means 28 has an "L"

shaped portion 56 which rests on a shoulder 58 of the flange 52.

In the installed position, the principal vane is held in both axial and radial positions by the inner and the outer case. The secondary vane is held in axial and radial positions, by virtue of its attachment to the principal vane.

As an added measure of safety insuring retention of the secondary vane in the installed position, the platforms are configured to provide joining surfaces 30 and 32 in plane A at the inner platforms and to provide joining surfaces 30 and 32 in plane B at the outer platforms. The surfaces 30 of the principal vane are both inwardly facing and the surfaces 32 of the secondary vane are both outwardly facing. Accordingly, the secondary vane cannot be displaced radially with respect to the principal vane, even upon failure of the direct attachment between the vanes.

In one more detailed embodiment the planes A and B are oriented to give the platforms a trapezoidal contour. The longer of the two parallel sides of each platform aligns with the shorter of the two parallel sides of the adjacent platform. Resultantly, the secondary vane cannot be displaced axially with respect to the principal vane, even upon failure of the direct attachment between the vane.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of my invention, that which I clam as new and desire to secure by Letters Patent of the United States is:

1. In a vane cluster formed of a first vane having an inner platform and an outer platform, and a second vane having an inner platform and an outer platform, the improvement comprising:

first and second vanes joined at the inner platforms along a plane A and at the outer platforms along a plane B wherein the planes A and B intersect along a line of intersection which passes between the inner and outer platforms and are oriented so as to form inwardly facing, joining surfaces on one of said vanes and outwardly facing, joining surfaces on the other of said vanes.

2. The invention according to claim 1 wherein the planes A and B are further oriented such that each of the platforms of the vanes have a trapezoidal geometry including a longer parallel side and a shorter parallel side and wherein the longer parallel side of one of said platforms aligns with the shorter parallel side of the adjacent platform.

3. A stator vane cluster of an axial flow gas turbine engine, wherein the cluster has an upstream end and a downstream end and comprises:

a first vane having an inner platform and an outer platform, each platform having a trapezoidal shape including a longer parallel side and a shorter parallel side; and a second vane having an inner platform and an outer platform, each platform having a trapezoidal shape including a longer parallel side and a shorter parallel side wherein the longer parallel side of the inner platform of the first vane aligns with the shorter parallel side of the inner platform of the second vane at the upstream end of the vane cluster and wherein the shorter parallel side of the outer platform of the first vane aligns with the longer parallel side of the outer platform of the second vane at the upstream end of the vane cluster.

* * * * *